US005197517A

United States Patent [19]

Perera

[11] Patent Number: 5,197,517

[45] Date of Patent: Mar. 30, 1993

[54] VALVE DEVICES

[75] Inventor: Guruge E. L. Perera, Wembley, England

[73] Assignee: GEC-Marconi Limited, England

[21] Appl. No.: 819,851

[22] Filed: Jan. 13, 1992

[30] Foreign Application Priority Data

Jan. 11, 1991 [GB] United Kingdom ..... 9100679

[51] Int. Cl.[5] ..... F15C 1/16

[52] U.S. Cl. ..... 137/813; 137/812; 137/833; 251/368

[58] Field of Search ..... 137/808, 812, 813, 833; 251/368

[56] References Cited

U.S. PATENT DOCUMENTS

| | | | |
|---|---|---|---|
| 3,324,891 | 6/1967 | Rhoades | 138/43 |
| 3,496,961 | 2/1970 | Erwin | 137/812 |
| 3,507,116 | 4/1970 | Berry | 137/808 |
| 3,515,158 | 6/1970 | Utz | 137/812 |
| 3,528,445 | 9/1970 | Shinn et al. | 137/833 |
| 3,712,321 | 1/1973 | Bauer . | |
| 4,846,224 | 7/1989 | Collins et al. | 137/810 |

FOREIGN PATENT DOCUMENTS

| | | |
|---|---|---|
| 0213808 | 3/1987 | European Pat. Off. . |
| 507713 | 9/1930 | Fed. Rep. of Germany . |
| 1901010 | 1/1973 | Fed. Rep. of Germany . |
| 1256903 | 12/1971 | United Kingdom . |
| 1455418 | 11/1976 | United Kingdom . |
| 2020850 | 11/1979 | United Kingdom . |
| 1575394 | 9/1980 | United Kingdom . |

*Primary Examiner*—A. Michael Chambers
*Attorney, Agent, or Firm*—Kirschstein, Ottinger, Israel & Schiffmiller

[57] ABSTRACT

A miniature non-return valve comprises a circular recess with an inlet at its center, an annular groove coaxial with the recess and communicating with the recess at a number of points within the groove, and an outlet duct communicating with the groove. Fluid entering the inlet passes through the recess, the annular groove and the outlet duct substantially unimpeded, whereas fluid entering the outlet duct forms a vortex in the recess so that flow of that fluid to the inlet is inhibited. Control fluid may be fed into the recess to initiate or enhance formation of the vortex. The inlet and the circular recess may be provided in first and second substrates, respectively, and the annular groove and the outlet duct may be provided in a third substrate, all by a micromachining process, the substrates being bonded together in a stack. The substrates may be formed of silicon.

6 Claims, 2 Drawing Sheets

VALVE DEVICES

BACKGROUND OF THE INVENTION

1. Field of the Invention

This invention relates to valve devices, and particularly to miniature non-return valves.

2. Description of Related Art

Various types of miniature non-return valve structures are known, and each type relies on the movement of one or more mechanical parts to allow fluid to flow through the valve in one direction, but to inhibit flow of the fluid in the opposite direction.

SUMMARY OF THE INVENTION

It is an object of the present invention to provide a miniature non-return valve which does not rely on any moving parts for its operation.

According to the invention there is provided a non-return valve comprising a circular recess; an inlet substantially coaxially aligned with the recess; an annular groove substantially coaxially aligned with the recess and communicating with the recess at a plurality of points within the groove; and an outlet duct communicating with the groove, whereby fluid entering the inlet passes through the recess, the annular groove and the outlet duct substantially unimpeded, whereas fluid entering the outlet duct is caused to form into a vortex in said recess, and flow of that fluid to the inlet is thereby substantially inhibited.

Preferably the recess is provided in a first substrate and the annular groove and the outlet duct are provided in a second substrate attached to said first substrate.

BRIEF DESCRIPTION OF THE DRAWINGS

An embodiment of the invention will now be described, by way of example, with reference to the accompanying drawings, in which.

DETAILED DESCRIPTION OF THE PREFERRED EMBODIMENTS

Figure 1:
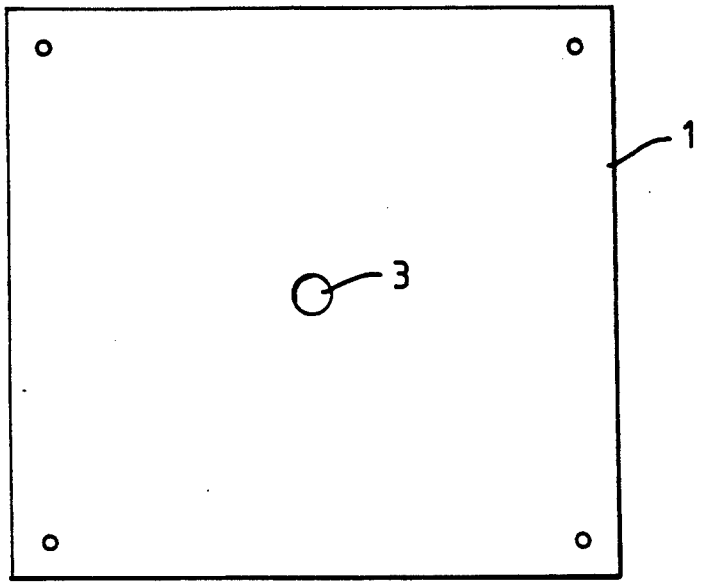
FIGS. 1, 2 and 3 are schematic plan views of first, second and third substrates, respectively, which together form a vortex valve in accordance with the invention.
Figure 2:
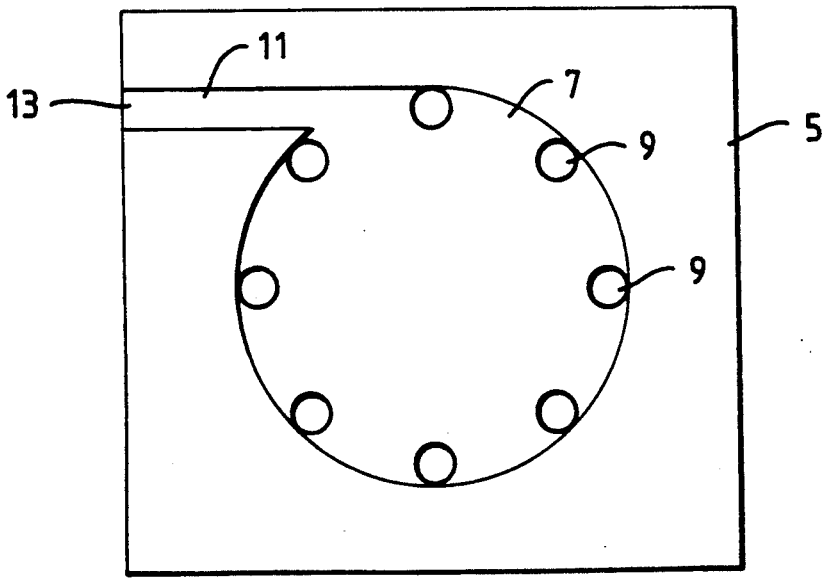

Referring to FIG. 1, a first substrate 1 has a central aperture 3 therethrough. FIG. 2 shows a second substrate 5 having a circular recess 7 formed in its upper surface. Eight apertures 9 extend downwardly from the recess 7 at equal angular spacings. A control groove 11 extends tangentially from the recess 7 to a control inlet 13. A third substrate 15 (FIG. 3) has an annular groove 17 therein, of outside diameter similar to that of the recess 7. An outlet duct 19 extends radially from the groove 17 to the edge of the substrate. The substrates may be formed of silicon.

Figure 4:
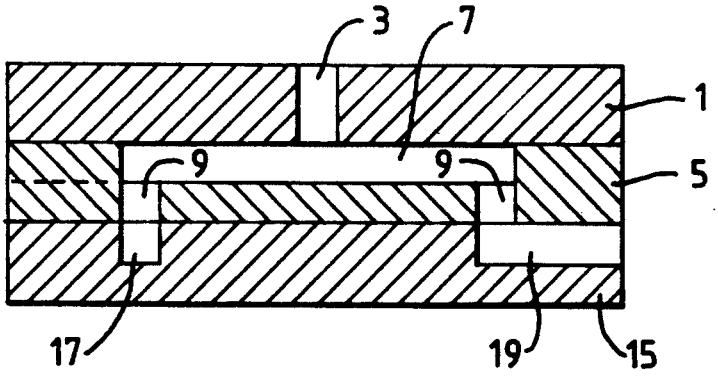
FIG. 4 is a schematic sectional view of the valve.

The substrates 1,5 and 15 are bonded together so that the recess 7 and the groove 17 are aligned coaxially, and the aperture 3 is centrallized over the recess 7. FIG. 4 shows a schematic cross-sectional view of the assembled device.

In operation of the device, fluid entering the aperture 3 will pass into the recess 7, through the apertures 9, into the groove 17, and out of the outlet duct 19, with little impedance. If fluid is caused to enter the outlet duct 19, on the other hand, it will divide on entry to the groove 17. Some of the fluid will pass in one direction round the groove and the rest in the opposite direction. The fluid will pass through the apertures 9 and into the recess 7. If control fluid is injected into the control duct 11 via the inlet 13 it will cause the fluid in the recess 7 to rotate clockwise as viewed in FIG. 2. A vortex will therefore be produced in the recess, and the fluid will not pass out of the aperture 3. The fluid flow through the valve is therefore unidirectional.

Figure 3:
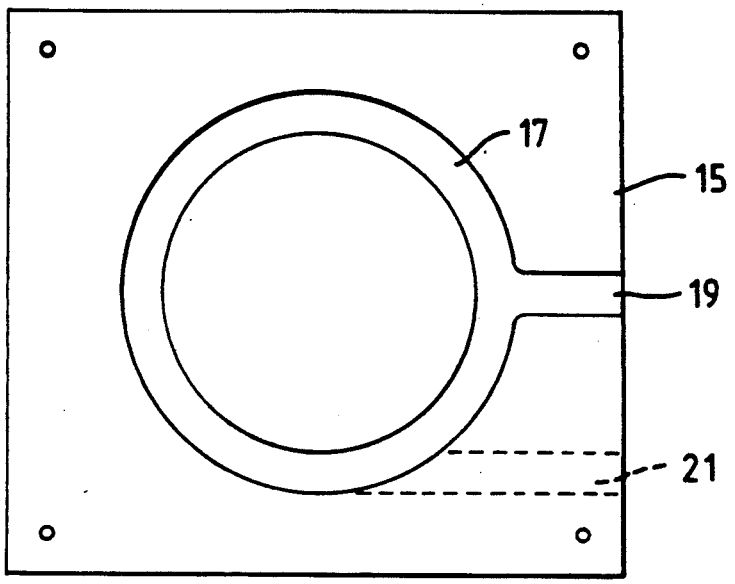

In an alternative arrangement, the outlet duct is positioned to be tangential to the groove 17, as shown by a dotted line at 21 in FIG. 3. Fluid entering via the aperture 3 passes through the valve to the outlet duct 21 substantially unimpeded, as before. If fluid is caused to enter the outlet duct 21, it will rotate round the groove 17 in a clockwise direction (as viewed in FIG. 3), pass up through the apertures 9 and enter the recess 7. It will still have a tendency to rotate clockwise, and a vortex will be set up in the recess 7, even without the injection of fluid into the control duct 13. That duct could, therefore, be omitted from the device. However, the control duct could alternatively be retained, and the injection of fluid into that duct would then increase the clockwise flow of the fluid and thereby enhance the formation of the vortex.

The dimensions of the substrates and of the cavities and apertures formed therein may be, for example, as follows:

substrate 5
- thickness 200 μm
- depth of recess 7 100 μm
- diameter of recess 7 1000 μm
- diameter of apertures 9 100 μm
- width of control duct 11 100 μm
- depth of control duct 11 100 μm substrate 1
- thickness immaterial
- diameter of aperture 3 100 μm substrate 15
- thickness immaterial
- inner diameter of groove 17 800 μm
- outer diameter of groove 17 1000 μm
- depth of groove 17 100 μm
- width of outlet duct 19 (or 21) 100 μm
- depth of outlet duct 19 (or 21) 100 μm A pair of valves in accordance with the invention may be used in, for example, a microminiature pump, and other components of the pump may be formed on the same substrates as the valve components.

I claim:

1. A miniature, non-return valve, comprising: a layer structure having an inlet in a first layer; a circular recess in a second layer and substantially coaxially aligned with the inlet; an annular groove in a third layer and substantially coaxially aligned with the recess and communicating with the recess through a plurality of apertures spaced apart around the groove; and an outlet duct communicating with the groove, whereby fluid entering the inlet passes through the recess, the annular groove and the outlet duct substantially unimpeded, whereas fluid entering the outlet duct is caused to form into a vortex in said recess, and flow of that fluid to the inlet is thereby substantially inhibited.

2. A valve as claimed in claim 1, including means to feed control fluid into the recess to initiate or enhance formation of the vortex.

3. A valve as claimed in claim 1, wherein the recess is provided in a first substrate, and the annular groove and the outlet duct are provided in a second substrate which is attached to said first substrate.

4. A valve as claimed in claim 3, wherein the inlet is provided in a third substrate which is attached to said first substrate.

5. A valve as claimed in claim 3, wherein the recess, the annular groove and the outlet duct are formed in the substrates by a micromachining process.

6. A valve as claimed in claim 3, wherein each substrate is formed of silicon.

* * * * *